United States Patent [19]

Rubio

[11] 4,169,533

[45] Oct. 2, 1979

[54] METHOD OF TREATING SPONGE IRON

[75] Inventor: Charles A. Rubio, Houston, Tex.

[73] Assignee: CVG-Siderurgica Del Orinoco, C.A., Venezuela

[21] Appl. No.: 844,733

[22] Filed: Oct. 25, 1977

[51] Int. Cl.[2] ..... B07B 4/02

[52] U.S. Cl. ..... 209/11; 209/139 R; 209/466; 75/34

[58] Field of Search ..... 209/11, 138, 139 R, 209/20, 19, 466, 474, 44; 75/26, 0.5 BA, 35, 34; 432/15, 16; 165/104 E; 198/756, 952; 34/13, 62, 66, 164

[56] References Cited

U.S. PATENT DOCUMENTS

| | | | |
|---|---|---|---|
| 2,557,059 | 6/1951 | de Marchi | 209/11 X |
| 2,847,767 | 8/1958 | Carrier | 198/756 X |
| 2,939,411 | 6/1960 | Priestley | 209/11 |
| 2,963,152 | 12/1960 | Leslie et al. | 209/139 R X |
| 2,983,051 | 5/1961 | Zimmermann et al. | 34/164 |
| 3,089,253 | 5/1963 | Evans | 209/466 X |
| 3,131,052 | 4/1964 | Peras | 75/34 X |
| 3,929,417 | 12/1975 | Rosa et al. | 209/11 X |

*Primary Examiner*—Ralph J. Hill

*Attorney, Agent, or Firm*—Pravel, Gambrell, Hewitt, Kirk, Kimball & Dodge

[57] ABSTRACT

A method of reducing the temperature of sponge iron to a safe level for storage and shipment including the steps of transferring freshly prepared sponge iron in particulate form to a separator vessel, such sponge iron being at dangerously high temperatures rendering it susceptible to oxidation; passing a cooling gas stream through the sponge iron in order to initially cool and fluidize the sponge iron and transfer smaller particles and fines away from the larger, more solid sponge iron particulate; conveying by vibration the remaining sponge iron towards a storage area and applying the cooling gas to the remaining sponge iron as it is conveyed towards storage in order to reduce the average temperature of the sponge iron to a safe level.

7 Claims, 4 Drawing Figures

METHOD OF TREATING SPONGE IRON

BACKGROUND OF THE INVENTION

This invention relates to the treatment of pyrophoric materials such as sponge iron.

Sponge iron is a product utilized in the steel making industry as a basic source for the production of steel. Generally speaking, sponge iron is produced by exposing hematite ($Fe_2O_3$) iron ore in comminuted form to a reducing gas environment at temperatures somewhat below blast furnace temperatures. The production of sponge iron is the subject of a large number of patents, including the following U.S. Pat. Nos. 2,243,110; 2,793,946; 2,807,535; 2,900,247; 2,915,379; 3,128,174; 3,136,623; 3,136,624; 3,136,625; 3,375,098; 3,423,201; 3,684,486; 3,765,872; 3,770,421; 3,779,741; 3,816,102; 3,827,879; 3,890,142; and, 3,904,397. The final sponge iron product of practically all of the processes disclosed in these patents is in a particulate or pellet form.

Typically, the components of sponge iron are metallic iron, iron oxide, gangue and possibly carbon. Metallic iron is iron which has been totally reduced by the reducing gas environment. Gangue is the term used in the industry to refer to all non-ferrous material, except carbon contained in the ore. Gangue may include silica, alumnia, lime, magnesia, phosphorus, sulfer and possibly other materials. A deposit of carbon on the outside surface of the sponge iron particulate will be described in greater detail hereinafter. In all of the iron ore reduction processes just referred to, freshly produced sponge iron as found in the final vessel in the process is at a very high temperature, typically at 1500° F. or even higher. The freshly produced sponge iron at high temperature must be moved from the final reactor to some type of storage location or be immediately utilized in a steel producing process. In the past, it was more typical that the freshly produced, high temperature sponge iron be used rather quickly in the production of steel. However, in the last few years, this situation has changed. There are more and more iron ore reducing plants being built in various parts of the world entirely removed from steel producing facilities. Therefore, it has become necessary that sponge iron be stored and even shipped long distances.

Freshly produced sponge iron at high temperatures is not a stable material. In fact, such sponge iron is pyrophoric and subject to degradation through oxidation by exposure to air or water.

Storage and shipment of sponge iron is not a new problem. But, the importance of pacifying the sponge iron has now reached great significance. Attempts to at least partially cool the sponge iron to a safe temperature are found in the prior art. It is known that freshly reduced sponge iron must be cooled down significantly. Some cooling has been incorporated into the reduction process. Generally, this initial cooling occurs while the just-reduced sponge iron is still in the reduction reactor. U.S. Pat. No. 3,904,397 of Celada and others discloses the utilization of cooled, spent reducing gas in such a cooling reactor. Other U.S. patents which refer generally to the utilization of a cooling step immediately after reduction include U.S. Pat. Nos. 3,765,872; 3,684,486; 3,136,625; 3,136,624; and, 3,136,623.

U.S. Pat. Nos. 3,816,102 of Celada et al. and 3,136,624 of Mader et al. disclose a process for coating or depositing a layer of carbon onto the hot sponge iron during the initial cooling of the just-reduced sponge iron. Carbon is deposited for the next step in the process, i.e., the electric furnace, which converts the iron to steel, and also the carbon present reacts with the remaining iron oxide to finish the reduction ($FeO+C \rightarrow CO+Fe$). One of the results of the deposition of the carbon layer on the sponge iron is the formation of a protective shell against reoxidation of the hot sponge iron because iron combined with carbon such as $Fe_3C$ is supposedly less sensitive to oxygenation than the reduced metallic sponge iron. "Storage and Transportation of HYL DRI Pellets" presented by Ing. Raul G. Quintero, Hylsa, S.A. and Mr. G. E. McCombs, Pullman Swindell, Third Direct Reduction Congress, Instituto Latinoamericano del Fierro y el Acero, Caracas, Venezuela, July, 1977. U.S. Pat. No. 3,423,201 of Celada et al. discloses a method for cooling sponge iron having such a carbon layer deposited thereon. In Celada U.S. Pat. No. 3,423,201, a second cooling step is initiated when the temperature of the reduced ferrous material in the cooling reactor has dropped below the value at which cracking of reducing gas (and thus depositing of carbon on the sponge iron particulate) occurs. The Celada U.S. Pat. No. 3,423,201 states that the sponge iron is cooled to a temperature "near room temperature."

Basically, all of the just-discussed patents disclose the cooling of the sponge iron while still in a reactor. In order to cool the sponge iron in a reactor, it is necessary for the cooling gas to flow through the pile of sponge iron. Typically, the cooling gas takes the paths of least resistance and therefore is not equally distributed among all the sponge iron particulate. Further, the cooling gas serves to deposit fines in particular locations out of the flow paths of direct cooling gas flow so that hot spots of fines are formed. Such fines may also clog flow paths through the particulate and thus prevent cooling.

If the sponge iron is dumped from the reactor with certain portions at dangerously high temperatures, the likelihood of a significant portion of the entire batch or pile of sponge iron being eventually re-oxidized is high. This re-oxidation may not occur until the sponge iron is already on board a ship and in the middle of an ocean. The dangers to personnel of this type of fire, in addition to the economic loss, are considerable.

Another proposed solution to this problem has been suggested by the Midrex Corporation. Midrex Corporation has made public a chemical treating process sold under the trademark CHEMAIRE. The CHEMAIRE process is a combination of chemical treatment and air passivation to inhibit rusting and re-oxidation. "Direct From Midrex," Vol. 3, No. 2 brochure. Disadvantages of this type of system are several. First of all, the complete distribution of the chemical upon the particulate sponge iron is very unlikely. Secondly, the addition of the chemicals may or may not have any effect upon subsequent use of the sponge iron in the production of steel.

In summary, it was long ago recognized that sponge iron must be reduced below dangerous temperature levels in order to prevent re-oxidation. The main or most common method that has been used as disclosed in U.S. patents has been to cool the sponge iron while in the final reactor. Industrial practice has proven that cooling of the sponge iron in the final reactor has not been totally satisfactory. One possible solution to the problem as shown in the prior patents has been to dispose a layer of carbon upon the sponge iron during the cooling process. However, it has been found in practice that the carbon layer does not eliminate the problem since the core of the particulate sponge iron pellets may remain at too high a temperature and eventually re-oxidize upon exposure to air or water. Finally, a chemical treatment has been proposed, one disadvantage to such treatment being a likelihood of inadequate distribution of the chemical upon the particulate sponge iron.

SUMMARY OF THE INVENTION

It is an object of this invention to provide a new and improved method for reducing the temperature of freshly-reduced sponge iron to a safe level for storage and shipment. In summary, the method of treating sponge iron disclosed here includes the steps of transferring freshly-reduced sponge iron in particulate form to a separator vessel and passing a cooling gas stream through the sponge iron in order to initially cool and fluidize lighter or smaller particles and fines. The lighter particles and fines are then transferred by fluidization so that only the larger or heavier, more solid sponge iron particles remain. The sponge iron remaining is then transferred by vibratory conveyor towards a storage area; and, the cooling gas is applied to the remaining sponge iron simultaneously with conveyance by vibratory motion toward a storage area in order to reduce the average temperature of the sponge iron to a safe level.

This summary of the invention is not intended to fully and accurately describe any or all of the patentable features of this invention. The features for which patent protection has been sought are set forth in the claims.

DESCRIPTION OF THE PREFERRED EMBODIMENT

Figure 2:
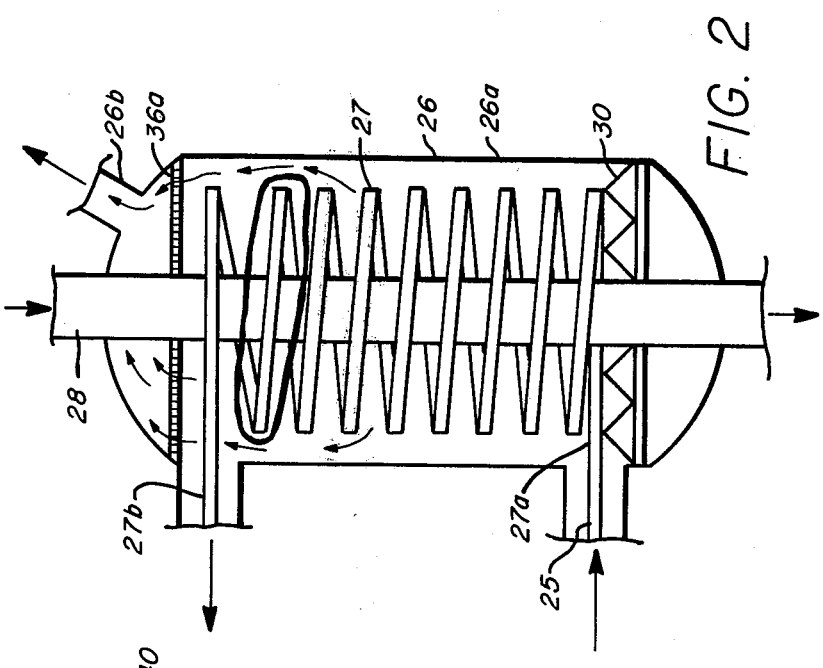
FIG. 2 is a side, schematic view of the vessel containing the apparatus for simultaneously conveying and cooling certain sponge iron particulate.
Figure 3:
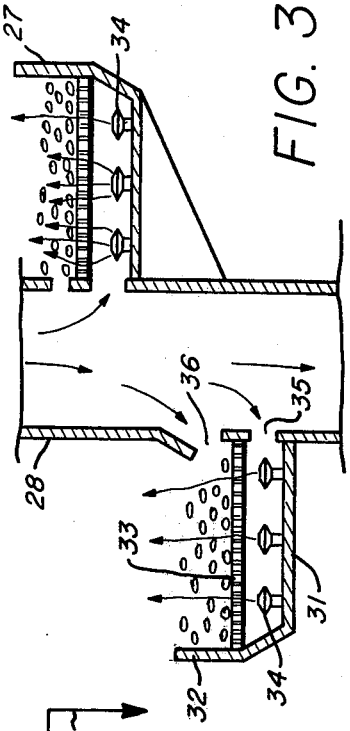
FIG. 3 is a schematic, sectional view of a portion of the apparatus of FIG. 2.
Figure 1:
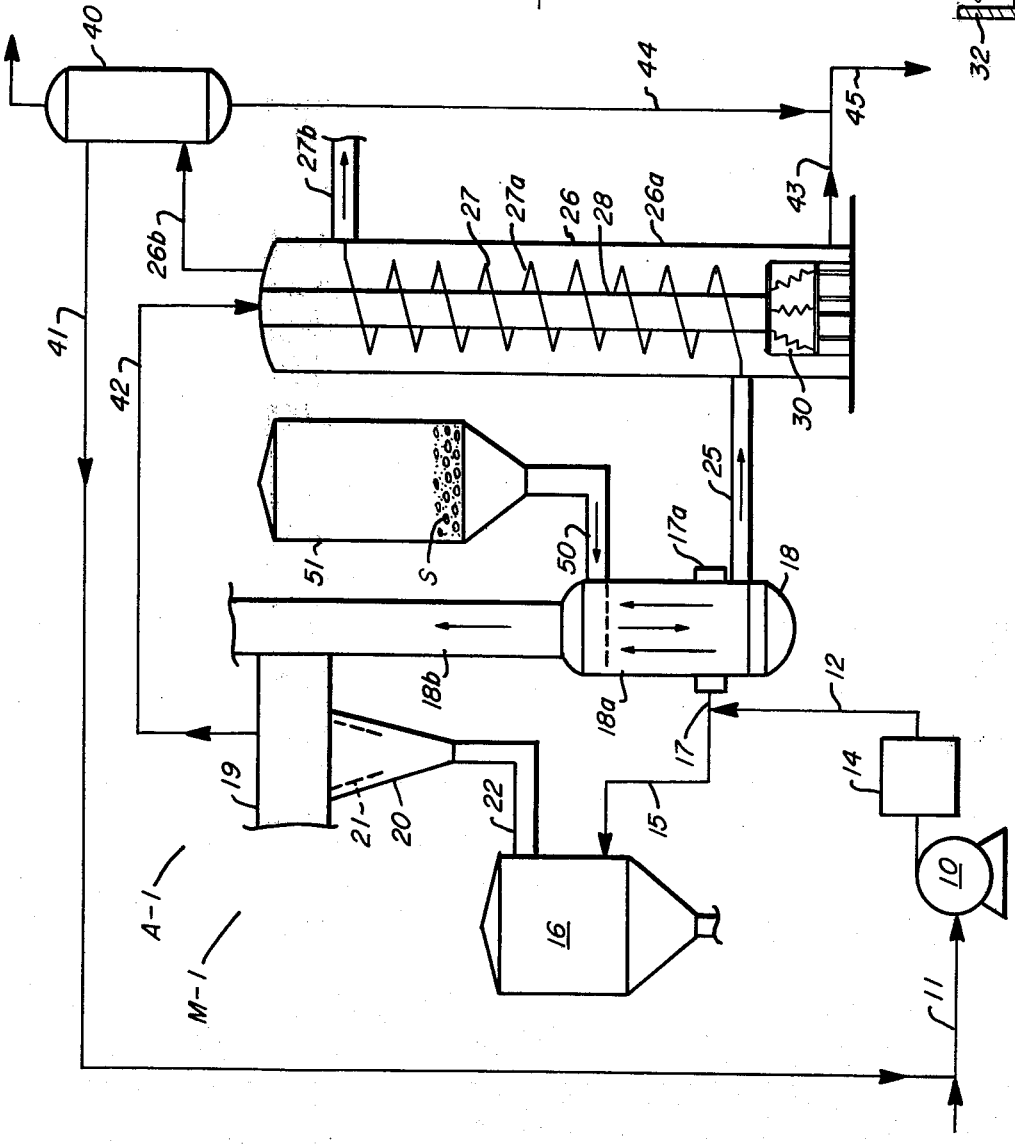
FIG. 1 is a schematic flow chart of a method for reducing the temperature of freshly reduced sponge iron to a safe level of this invention.
Figure 4:
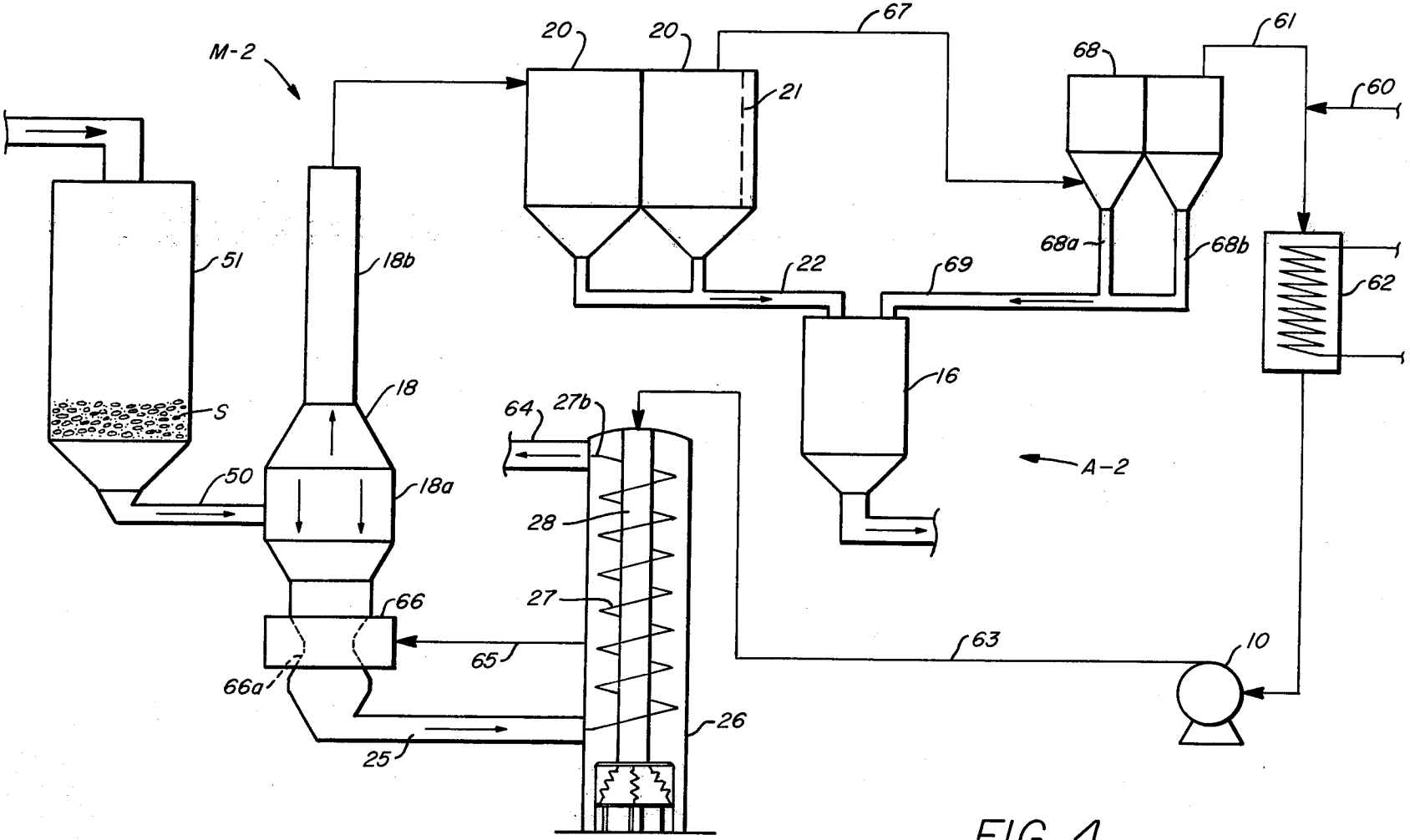
FIG. 4 is a schematic flow chart view of another embodiment of the method for reducing the temperature of recently-produced sponge iron to a safe level.

Referring to the drawings, FIGS. 1–3 illustrate a method generally designated as M-1 for reducing the temperature of freshly-reduced sponge iron to a safe level for storage and shipment. A second, equally important method M-2 for reducing the temperature of recently-produced sponge iron is illustrated in FIG. 4.

The method M-1 is carried out by the apparatus generally designated by the number A-1 in FIG. 1. The apparatus A-1 includes compressor 10 which is connected to inlet gas feed line 11 at its inlet and to outlet, compressed gas line 12 at its outlet. A cooling coil 14 is mounted in the compressed gas outlet line 12 for cooling the compressed gas prior to introduction through connecting line 15 to fines bin 16. The compressed gas line 12 is also connected by line 17 to a separator vessel or reactor 18.

The separator reactor 18 includes a main vessel housing **18*a* having a cylindrical riser 18*b* extending upwardly therefrom. The riser 18*b* is connected to conduit 19 which empties into a cyclone separator 20**.

The cyclone separator 20 can be one of a number of commercially manufactured units, followed by a secondary dust removal system such as a bag house, electrostatic precipitator, or other commercially available equipment. The gas and fines in the cyclone separator are cooled by any type of surrounding water jacket structure such as shown schematically at 21. The filtering apparatus 20 is connected by collection conduit 22 to the fines bin 16.

A horizontal vibratory conveyor apparatus 25 is mounted in the bottom of the reactor vessel housing **18*a* for conveying sponge iron particulate from the vessel housing 18*a* to cooling reactor 26**.

The cooling reactor 26 is shown schematically in FIG. 1 and in somewhat more detail, but also schematically, in FIGS. 2 and 3. A generally cylindrical vessel **26*a* mounts a vibratory spiralling conveyor platform 27 having a central support tube 28. The entire spiralling conveyor is permanently attached to the central support tube 28 and terminates in a horizontal entry conveyor portion 27*a* at the bottom thereof and in a horizontal exit conveyor portion 27*b* at the top thereof. The spiralling conveyor 27 and support tube 28 are both mounted for vibratory motion by a vibration imparting mechanism illustrated schematically and designated as 30. One such vibratory spiralling conveyor 27 having a central support tube 28 in vibratory mechanism 30** is available from Carrier Corporation.

Referring to FIG. 3, the spiralling conveyor 27 is formed by a spiralling platform 31 which is welded or otherwise connected to the central support tube or shaft 28. A side member or edge 32 is attached to the spiralling platform 31 and a second, perforated spiralling plate or deck 33 is attached to the side member 32 and extends parallel to the platform 31 for vibration therewith. The spiralling platform or deck 33 is also attached by suitable braces (not shown) to the central support tube 28. A plurality of nozzles 34 are mounted on the spiralling support platform 31 and are directed upwardly to spray fluid, liquid or gas upwardly through the perforated deck 33 into the sponge iron mass S supported on the plate 33. Openings 35 and 36 are positioned in the central support tube 28 above and below the perforated supporting deck 33 for passing a cooling gas both above and below the deck 33. The cooling gas is then circulated outwardly of the spiralling conveyor 27 and upwardly through the vessel top perforated support barrier **36*a* to reactor outlet 26*b***.

The gas outlet conduit **26*b* for cooling reactor vessel 26 is attached to a wet scrubber 40. The wet scrubber 40 is connected to conduit 41 which extends back into connection with inlet line 11**.

The central support tube 28 of the cooling reactor 26 is connected to conduit 42 which provides for the transfer of cooling gas from separator 20 into the central support tube 28 for flow through the vibrating, spiralling deck 33 and the sponge iron positioned thereon.

A solids collection conduit 43 is attached to the bottom of the central support tube 28 and another solids collection conduit 44 is attached to the bottom of the wet scrubber 40. The conduits 43 and 44 are adjoined to a common solids collection line 45 which extends to a suitable collection point for collecting dust, fines and other miscellaneous particulate which may collect in either apparatus.

In practicing the method M-1 of this invention, recently-reduced sponge iron S is delivered into separator vessel housing **18*a* through horizontal conveyor 50** from reactor vessel 51, which is actually part of a sponge iron reducing system.

As the sponge iron enters the vessel housing 18*a* from vibrating conveyor 50, it tends to fall downwardly due to gravity. Cooling gas entering through line 17 and gas plenum 17*a* mounted about separator vessel housing 18*a* flows upwardly to fluidize the falling sponge iron particulate. Fluidization of the sponge iron particulate by the cooled gas serves both to reduce the temperature of the particulate and to separate and remove smaller or lighter particles and fines of the sponge iron for fluidized transfer upwardly through tubular riser 18*b*. The remaining sponge iron particulate, which is principally heavier or larger, solid sponge iron particles or pellets, flows downwardly and into horizontal conveyor 25.

The separated fines flow upwardly through riser tube 18*b*, through conduit 19 into the separator 20 wherein the fines are separated from the gas, the cleaned cooling gas flowing through conduit 42 to the central support tube 28 of cooling reactor 26 and the separated or filtered fines and smaller particles being transferred through conduit 22 to the fines bin 16. The fines and smaller particles may be transferred from the fines bin 16 under gas pressure from the line 15 to a briquetting plant or other destination.

The remaining sponge iron travels along conveyor 25 and enters the spiral vibratory conveyor 27 at 27*a* and travels upwardly around tube 28 toward outlet 27*b*.

The clean cooling gas enters the central support tube 28 from conduit 42 and flows downwardly therethrough and outwardly of the tube 28 through openings such as 35 and 36 above and below the vibrating, perforated support deck 33. The cooling gas passes over the vibrating solid sponge iron particles and cools the sponge iron particles as they are transferred upwardly along the spiral path to the exit 27. The temperature of the cooling gas flowing radially outwardly through openings such as 35 and 36 is sufficiently low, and the exposure of the solid particulate as it is vibrated is sufficiently great, that the sponge iron particulate is reduced to a safe temperature prior to exit at vibratory conveyor exit point 27*b*. The cooling gas flows outwardly through the vibrating remaining sponge iron particulate and into the interior 26*a* of the cooling vessel 26 and upwardly through the perforated barrier 36*a* into outlet conduit 26*b*. The cooling gas, which will undoubtedly contain some more fines and perhaps dust, is then cleaned in the wet scrubber 40 before flowing through conduit 41 back to entrance line or conduit 11. The sponge iron coming out of the cooling reactor 26 at conveyor exit 27*b* is now at a sufficiently low temperature that it will not re-oxidize upon contact with air or water and is thus safe for shipment and storage.

A further feature of this invention is the utilization of the nozzles 34 to provide a cooling liquid mist to the vibrating sponge iron particles. It is contemplated that this cooling mist will only be applied during the latter or upper spirals after the temperature of the vibrating sponge iron particulate has already been sufficiently reduced. Basically, the addition of the mist is to finally prepare the vibrating, cooled sponge iron particulate for exposure to the environment at the exit conveyor 27*b*.

The method M-2 of reducing the temperature of recently-produced sponge iron is accomplished by apparatus A-2 of FIG. 4. Basically, the same equipment is utilized in apparatus A-2 as in apparatus A-1. Therefore, wherever possible, the same number or letter designations will be utilized. The method M-2 for reducing the temperature of recently-produced sponge iron is provided by transferring sponge iron S from reactor bin 51 through vibratory conveyor 50 to the separator or fluidizing vessel 18. The fluidizing vessel 18 includes a central fluidizing housing 18*a* having mounted thereon a riser tube 18*b*. Cooling gas enters the apparatus A-2 through entry line 60 and joins recycling gas from line 61 for cooling through cooling coil 62. The cooled gas is then compressed in compressor 10 for delivery to compressed cooling gas line 63 connected to the central support tube 28 of the cooling reactor 26. The compressed, cooled gas flows outwardly through the vibrating spiralled conveyor 26 in the same manner as has been described with respect to the method M-1. The finally cooled sponge iron exits through conveyor 64 which is attached to the top exit spiralled conveyor portion 27*b*. The cooling gas, however, is not at this point collected and filtered for reuse as in the method M-1, but rather, the cooling gas of the method M-2 exits through line 65 which is connected to vessel plenum chamber 66. The vessel plenum chamber 66 is an annular chamber that surrounds the fluidizing vessel housing 18*a*, which is provided with suitable openings such as 66*a* illustrated schematically in FIG. 4, for allowing gas entry into the vessel 18*a* for fluidizing the sponge iron coming off of conveyor 50. The fluidizing gas again separates fines and lighter sponge iron particles for transfer through riser conduit 18*b* into separators 20. The separators 20 are illustrated as being cyclone separators and again are water cooled by water jacketing at 21 for cooling the fines and lighter particles prior to collection in horizontal vibratory feeder 22 and subsequent depositing in the fines bin 16. The cooling gas cleaned of fines and lighter particles enters transfer conduit 67 for flow to bag house 68 and then flow into return line 61. The further filtered particles exit through lines 68*a* and 68*b* of the bag house and also enter the fines bin 16 through line 69. The recycled gas coming out of the bag house enters line 61 and is joined by makeup line 60 prior to entry into cooling coil 62. The fines again are sent to a briquetting process or other destination as desired.

The larger, more solid particulate flows downwardly through the separator housing 18*a* and into horizontal vibrating conveyor 25 for transfer to the spiralling or helical vibratory conveyor 27. As the more solid particles travel upwardly, cooling gas flowing through central support tube or downcomer 28 cools the vibrated particulate in the same manner as has been described with respect to FIGS. 2 and 3. In this manner, the temperature of the sponge iron leaving through the top spiral conveyor end portion 27*b* is reduced to a safe level thus pacifying the material for exposure to air or other ambient oxidizers.

In the embodiments of both processes M-1 and M-2, the cooling gas is an inert gas in that it has no oxidizing ingredients therein to re-oxidize with the recently-produced sponge iron. The inert gas may be any suitable reducing gas including a reducing tail gas taken from the reduction process itself; or, the cooling gas may be truly inert and thus incapable of oxidizing or reducing the particulate being cooled and separated.

The foregoing disclosure and description of the invention are illustrative and explanatory thereof, and various changes and alterations may be made without departing from the spirit of the invention.

I claim:

1. A method of deactivating recently-reduced sponge iron pellets for storage and shipment by reducing the temperature of the pellets and removing the sponge iron fines that are highly pyrophoric from the pellets, including the steps of:

transferring freshly reduced sponge iron from a reducing reactor to a separation vessel;

passing a non-oxidizing gas stream through the freshly reduced sponge iron and separating the sponge iron fines from the sponge iron pellets by fluidizing the sponge iron fines, which are carried away in the stream of non-oxidizing gas;

partly cooling the sponge iron pellets with the stream of non-oxidizing gas substantially simultaneously with the separation of the fines from the pellets;

transferring the sponge iron pellets from said separation vessel to a vibratory conveyor in a non-oxidizing environment;

conveying the sponge iron pellets along a vibratory, helical path toward a storage area; and directing a non-oxidizing cooling gas through the sponge iron pellets as they are vibratorily conveyed along said helical path to simultaneously convey and cool the remaining sponge iron pellets in order to reduce the temperature level substantially throughout the conveyed sponge iron pellets thereby cooling the sponge iron pellets substantially throughout to a temperature level where they are stable and their tendency to reoxidize is minimal.

2. The method set forth in claim 1, including the step of:

applying a cooling mist to the vibrated, sponge iron pellets simultaneously with the application of said cooling gas to the sponge iron pellets during the vibratory conveyance of same.

3. The method set forth in claim 1 including the steps of:

removing the sponge iron fines from the stream of non-oxidizing gas; and directing the sponge iron fines to a collection bin.

4. The method set forth in claim 1, including:

cooling the fluidized fines with the non-oxidizing gas in order to enhance cooling of the fines to a safe temperature.

5. The method as set forth in claim 1, wherein:

said non-oxidizing cooling gas is utilized in a substantially closed loop.

6. The method set forth in claim 1, wherein:

said non-oxidizing cooling gas is utilized in a substantially closed loop by first directing said cooling gas to said separator vessel for fluidizing the sponge iron fines, transferring said cooling gas with said sponge iron fines outwardly of said separating vessel, removing the sponge iron fines from the cooling gas and utilizing the cleaned cooling gas for cooling the remaining sponge iron pellets simultaneously with the conveyance of the remaining sponge iron toward said storage area along said vibratory, helical path and thereafter preparing said cooling gas for use again in fluidizing freshly prepared sponge iron in said separator vessel.

7. The method set forth in claim 1, including:

utilizing said cooling gas in a substantially closed loop by first utilizing said cooling gas for cooling said remaining sponge iron pellets during conveyance along a vibratory, helical path toward said storage area, thereafter utilizing said cooling gas for fluidizing said freshly prepared sponge iron for removing fines therefrom, and thereafter removing said fines from said cooling gas and finally, preparing said cooling gas for use in cooling said remaining sponge iron pellets again.

* * * * *